US006805110B2

(12) United States Patent
Park

(10) Patent No.: US 6,805,110 B2
(45) Date of Patent: Oct. 19, 2004

(54) IGNITION CONTROL METHOD AND APPARATUS OF AN ENGINE

(75) Inventor: Jin-Seo Park, Seoul (KR)

(73) Assignee: Hyundai Motor Company, Seocho-Ku (KR)

( * ) Notice: Subject to any disclaimer, the term of this patent is extended or adjusted under 35 U.S.C. 154(b) by 59 days.

(21) Appl. No.: 10/374,588

(22) Filed: Feb. 25, 2003

(65) Prior Publication Data

US 2003/0192506 A1 Oct. 16, 2003

(30) Foreign Application Priority Data

Apr. 12, 2002 (KR) ..... 2002-20025

(51) Int. Cl.[7] ..... F00P 9/00

(52) U.S. Cl. ..... 123/609; 123/610; 123/406.18; 123/406.58

(58) Field of Search ..... 123/609, 610, 123/406.18, 406.2, 406.58, 406.59, 406.6, 406.61

(56) References Cited

U.S. PATENT DOCUMENTS

| | | | | | |
|---|---|---|---|---|---|
| 3,882,840 | A | * | 5/1975 | Adamian et al. | 123/644 |
| 3,964,443 | A | * | 6/1976 | Hartford | 123/406.55 |
| 4,273,089 | A | * | 6/1981 | Maier | 123/406.63 |
| 4,284,045 | A | * | 8/1981 | Maier | 123/406.63 |
| 4,377,785 | A | * | 3/1983 | Ueno et al. | 324/378 |
| 4,377,996 | A | * | 3/1983 | Yamaguchi | 123/406.51 |
| 4,777,920 | A | * | 10/1988 | Oshiage et al. | 123/406.37 |
| 6,736,102 | B2 | * | 5/2004 | Konrad et al. | 123/295 |

* cited by examiner

*Primary Examiner*—John T. Kwon
(74) *Attorney, Agent, or Firm*—Morgan, Lewis & Bockius LLP

(57) ABSTRACT

The invention discloses an apparatus and method that calculates parameters for ignition control with respect to a reference cylinder every 180° of crank angle and actuates a dwell-on period and the ignition of the ignition cylinder based on those parameters. A timer-monitored period between crank-position sensor pulse is minimized by setting a reference angle, and misfires are prevented by forcing the dwell-on period and the ignition of the ignition cylinder based on a number of crank-position sensor pulses corresponding to a pre-dwell-on period. Errors relating to missing pulses are also prevented.

25 Claims, 5 Drawing Sheets

IGNITION CONTROL METHOD AND APPARATUS OF AN ENGINE

FIELD OF THE INVENTION

The present invention relates to an engine, and more particularly, to a method and apparatus for engine ignition control.

BACKGROUND OF THE INVENTION

The ignition timing of an engine substantially influences the performance of the engine and therefore has to be controlled precisely, cylinder by cylinder. Ignition timing is indicated by the rotation angle of the crankshaft with reference to TDC (Top Dead Center) during a piston stroke. The rotation angle of the crankshaft is detected by a crank-position sensor (CPS). A crank-position sensor includes a toothed gear and a magnetic sensor that generates pulse signals in response to the rotation of the teeth. This toothed gear is also sometimes a toothed ring that is placed about a rotating member of the crankshaft. The teeth are uniformly displaced except where a tooth is intentionally left out. A tooth or teeth are intentionally deleted from the toothed gear so the missing tooth region can be used to find a specific angular position on the crankshaft.

The resolution of the crank-position sensor depends on the number of teeth formed on the toothed gear. For example, if a toothed gear has 30 teeth (counting the missing teeth also), the angle between adjacent pulses of the toothed gear is 12°, and therefore the toothed gear has a resolution of 12°.

But the ignition timing must be controlled much more precisely than the resolution of this type of a crank-position sensor. Therefore, a timer is used to monitor the elapsed time between adjacent pulses and estimate when a desired between-pulse crank angle will arrive. For example, in the case of a toothed gear of 12° resolution, to find 18° BTDC (18° Before Top Dead Center), the pulse from 24° BTDC is detected and the remainder angle of 6° is estimated by the timer. In practical use, however, the 36° BTDC pulse is found (that is, the second pulse before the theoretically calculated one) and the remainder angle 18° is estimated by the timer. This takes into account the fact that a small time period is needed to execute the timer instructions in a control unit.

Another point to be considered regarding ignition is that the ignition coil must supply a sufficiently large current to a spark plug. To do this, an ignition coil conducts current for a predetermined time period (referred to as "dwell period"). The current begins at a point at which the dwell period starts (referred to as "dwell-on point"). After the dwell period from the dwell-on point, the current is stopped, causing ignition in a cylinder. This is the starting time point of the ignition and is referred to as the "ignition timing". The dwell angle is the crank angle change corresponding to the dwell period. To keep the dwell period to a specific value, dwell angle must be constantly re-calculated because the dwell angle varies in response to engine speed.

Therefore, the Dwell-On timing as well as the ignition timing must be precisely controlled based on the crank angle obtained by the crank-position sensor, and a lot of research regarding ignition control of an engine is related to increasing precision and accuracy thereof.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

A preferred embodiment of an engine ignition control apparatus includes: a crank-position sensor for generating a pulse signal at each rotation angle of a crankshaft of the engine except for one or more missing pulses; an engine speed detector for detecting engine speed; an ignition coil driven by an electric current for Dwell-On and Ignition-On activation, said ignition coil generating a voltage for ignition of the spark plug under said Ignition-On activation; and an electric control unit for controlling said Dwell-On and Ignition On activation of the ignition coil based on the pulse signal and the engine speed. The electric control unit executes a set of instructions including instructions for each step of an ignition control method of an engine according to the present invention.

An exemplary ignition control method according to an embodiment of the present invention includes: calculating a dwell angle and an ignition angle of a reference cylinder based on an engine speed; calculating a first number of pulses and a first timer-monitored angle corresponding to a pre-Dwell-On period with regard to the reference cylinder, the pre-Dwell-On period being a period from occurrence of a first reference pulse to a Dwell-On timing with regard to the reference cylinder; comparing the first number of pulses with a predetermined number corresponding to 180° of crank angle; determining an ignition cylinder based on the comparison of the first number with the predetermined number; and actuating ignition of a spark plug of the ignition cylinder based on the first number of pulses, the first timer-monitored angle, and the ignition angle of the reference cylinder.

The first reference pulse is preferably one of a secondly occurring pulse after a missing pulse of a crank-position sensor and a pulse having a 180° angular difference thereto.

In a further preferred embodiment, said calculating a first number of pulses and a first timer-monitored angle includes: comparing a remainder of a first operation with a reference angle, the first operation being an operation of dividing an angular difference acquired by subtracting the dwell angle and the ignition angle from a BTDC angle of the first reference pulse by an angular difference between adjacent pulses; determining, when the remainder of the first operation is greater than the reference angle, the first number of pulses as a quotient of the first operation and the first timer-monitored angle as the remainder of the first operation; and determining, when the remainder of the first operation is not greater than the reference angle, the first number of pulses as a quotient of the first operation subtracted by 1 and the first timer-monitored angle as the remainder of the first operation plus the angular difference between adjacent pulses.

The reference angle is preferably less than the angular difference between adjacent pulses and greater than an angle corresponding to a required time for a timer to be is activated. In practical use, the reference angle may preferably be set to about 5°.

In another further embodiment, said determining an ignition cylinder based on the comparison determines the ignition cylinder as the reference cylinder when the first number is not greater than the predetermined number, and as another cylinder otherwise.

In a further preferred embodiment, said actuating ignition of a spark plug of the ignition cylinder includes: reducing the first number of pulses by the predetermined number when the ignition cylinder is different from the reference cylinder; counting the first number of pulses from occurrence of the first reference pulse; monitoring by timer for the first timer-monitored angle after said counting the first number of pulses; and actuating Dwell-On of an ignition coil of the ignition cylinder when the first timer-monitored angle elapsed.

In a further preferred embodiment, said actuating ignition of a spark plug of the ignition cylinder further includes: determining if a determination state of said determining ignition cylinder has been changed from a state such that the ignition cylinder is different from the reference cylinder to a state such that the ignition cylinder is the reference cylinder; and forcibly actuating Dwell-On of an ignition coil of said another cylinder when the determination state is determined to have been changed.

The exemplary method that is useful with the present invention preferably further includes: determining if a target pulse occurring after the first number of pulses after the first reference pulse lies in a missing pulse range, said missing pulse range covering a missing pulse; reducing the first number of pulses, when the target pulse lies in the missing pulse range, such that the target pulse no longer lies in the missing pulse range; and increasing the first timer-monitored angle by an angle obtained by multiplying a reduced number of the first number of pulses by the angular difference between adjacent pulses. The missing pulse range preferably includes the missing pulse and a firstly occurring pulse after the missing pulse.

In a further preferred embodiment, said actuating ignition of a spark plug of the ignition cylinder further includes: calculating a second number of pulses and a second timer-monitored angle corresponding to a pre-Ignition-On period with regard to the ignition cylinder, the pre-Ignition-On period being a period from occurrence of a second reference pulse to an Ignition-On point with regard to the ignition cylinder; counting the second number of pulses from occurrence of the second reference pulse; monitoring by timer for the second timer-monitored angle after said counting the second number of pulses; and actuating Ignition-On of the ignition coil of the ignition cylinder when the second timer-monitored angle has elapsed.

In a further preferred embodiment, said calculating a second number of pulses and a second timer-monitored angle includes: comparing a remainder of a second operation with a reference angle, the second operation being an operation of dividing an angular difference acquired by subtracting the ignition angle from a BTDC angle of the second reference pulse by an angular difference between adjacent pulses; determining, when the remainder of the second operation is greater than the reference angle, the second number of pulses as a quotient of the second operation and the second timer-monitored angle as the remainder of the second operation; and determining, when the remainder of the second operation is not greater than the reference angle, the second number of pulses as a quotient of the first operation subtracted by 1 and the second timer-monitored angle as the remainder of the second operation plus the angular difference between adjacent pulses.

The reference angle is preferably less than the angular difference between adjacent pulses and greater than an angle corresponding to a required time for a timer to be activated. In practical use, the reference angle may preferably be set to about 5°.

In a further preferred embodiment, said actuating ignition of a spark plug of the ignition cylinder further includes: determining if a determination state of said determining an ignition cylinder has been changed from a state such that the ignition cylinder is different from the reference cylinder to a state such that the ignition cylinder is the reference cylinder; and forcibly actuating, when the determination state is determined to have been changed, Ignition-On of an ignition coil of said another cylinder synchronously with said actuating Ignition-On of the ignition coil of the ignition cylinder.

BRIEF DESCRIPTION OF THE DRAWINGS

The accompanying drawings, which are incorporated in and constitute a part of the specification, illustrate an embodiment of the invention, and, together with the description, serve to explain the principles of the invention.

Like numerals refer to similar elements throughout the several drawings.

DETAILED DESCRIPTION OF THE PREFERRED EMBODIMENTS

The resolution of a crank-position sensor depends on the total number of teeth of an adopted toothed gear and the present invention can be applied to a gear with any number of teeth. A preferred embodiment of the present invention is hereinafter described with reference to a toothed gear has a total of 30 teeth (counting the missing teeth). Also, a pulse may be measured from its rising edge or its falling edge. Hereinafter it will be described with respect to the falling edge unless otherwise specified. For demonstration purposes, the angular position of the missing teeth or tooth may be set as an arbitrary position. A preferred embodiment of the invention is hereinafter described on the premise that the missing teeth are at 96° BTDC and 108° BTDC (that is, the eighth and ninth tooth-positions before a tooth corresponding to TDC of cylinder #1). It will be appreciated by persons of ordinary skill in the art that these parameters are illustrative only and other parameters may be utilized without departing from the present invention.

Figure 1:
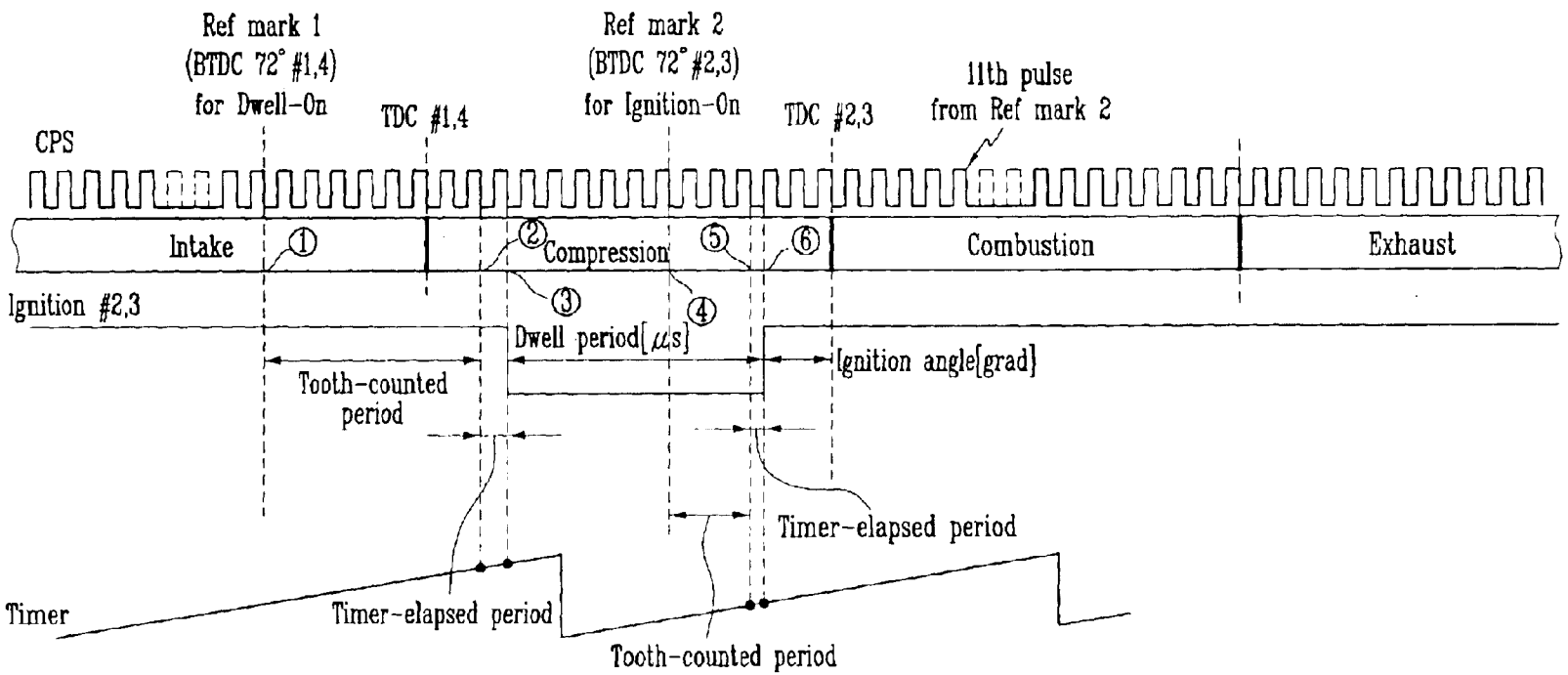
FIG. 1 is an exemplary timing diagram for showing a process of synchronous ignition, for example, at cylinders #2 and #3, in connection with received pulses from a crank-position sensor of an engine.

FIG. 1 is a timing diagram showing synchronous ignition in relation to pulses received from a crank-position sensor. In order to determine a specific point in time, a specific pulse must be referenced. As shown in FIG. 1, the pulse at 252° BTDC of cylinder #2 or #3 (that is, 72° BTDC of cylinder #1 or #4; point 1 in FIG. 1) is the first reference pulse for determining the arrival of the dwell-on point for cylinders #2 and #3. The pulse at 72° BTDC of cylinder #2 or #3 (time point 4 in FIG. 1) is the second reference pulse and is used for determining the point of arrival of the ignition-on point for cylinders #2 and #3.

The dwell-on point comes when a specific period (referred to as the "pre-dwell-on period" hereinafter) after the first reference pulse. The pre-dwell-on period ends after a number of pulses from the first tooth-counted period (period of 1 to 2 in FIG. 1) and after a first timer-monitored period (period of 2 to 3 in FIG. 1).

In the same way, the ignition-on point comes after a specific period (referred to as the "pre-ignition-on period" hereinafter) from the occurrence of the second reference pulse. The pre-ignition-on period ends after a number of pulses from a second tooth-counted period (period of 4 to 5 in FIG. 1), and after a second timer-monitored period (period of 5 to 6 in FIG. 1).

During a typical revolution of the crankshaft, firing occurs at alternating cylinders at each half-revolution of the crankshaft. Therefore, the dwell-on point and the ignition-on point must be determined every 180° rotation of the crankshaft with respect to alternating cylinders.

Figure 2:
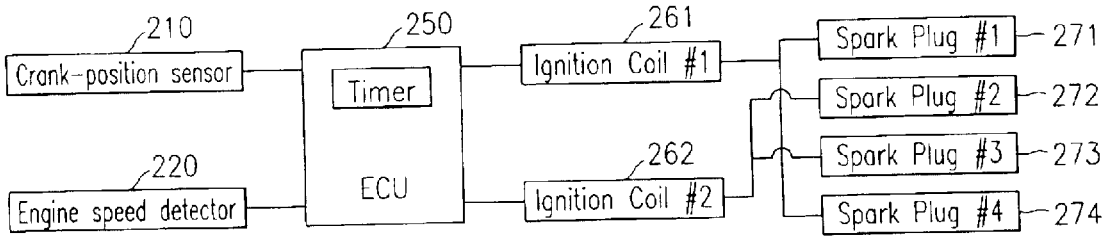
FIG. 2 is a block diagram of an ignition control apparatus according to a preferred embodiment of the present invention.

As shown in FIG. 2, an ignition control apparatus according to one embodiment has spark plugs 271, 272, 273, and 274, one for each cylinder. It also includes a crank-position sensor 210 that generates pulse signals corresponding to the rotation of the crankshaft except where teeth are missing from the toothed gear. An engine speed detector 220 detects engine speed and ignition coils 261 and 262 generate a voltage for ignition of the spark plugs upon activation at the ignition-on point. An electronic control unit (ECU) 250 controls the dwell-on and ignition-on activation of the ignition coils 261 and 262 based on the pulse signals and the engine speed. ECU 250 also includes a timer 255.

FIG. 2 shows an exemplary configuration of an ignition system wherein a first ignition coil 261 of two ignition coils 261 and 262 is connected to spark plugs 271 and 274 respectively installed to cylinders #1 and #4, and a second ignition coil 262 is connected to spark plugs 272 and 273 respectively installed to cylinders #2 and #3. However, the configuration is only exemplary for an ignition system wherein cylinders #2 and #3 are synchronously fired and cylinders #1 and #4 are synchronously fired. Various configurations, including a non-synchronous ignition system, may be adopted in the spirit of the present invention, and therefore it is to be understood that the invention is not limited to the configuration of FIG. 2.

The crank-position sensor 210 generates pulses at, in this example, every 12°. Pulses at 96° BTDC and 108° BTDC with respect to cylinder #1 are not generated because the teeth were intentionally deleted. These positions are referred to as "missing pulses" hereinafter.

The ECU 250 can be one or more processors programmed with software. The software includes instructions for each step of the ignition control method according to a preferred embodiment of this invention. The selection and programming of suitable hardware and software may be accomplished by a person of ordinary skill in the art based on the teachings herein provided.

Figure 3A:
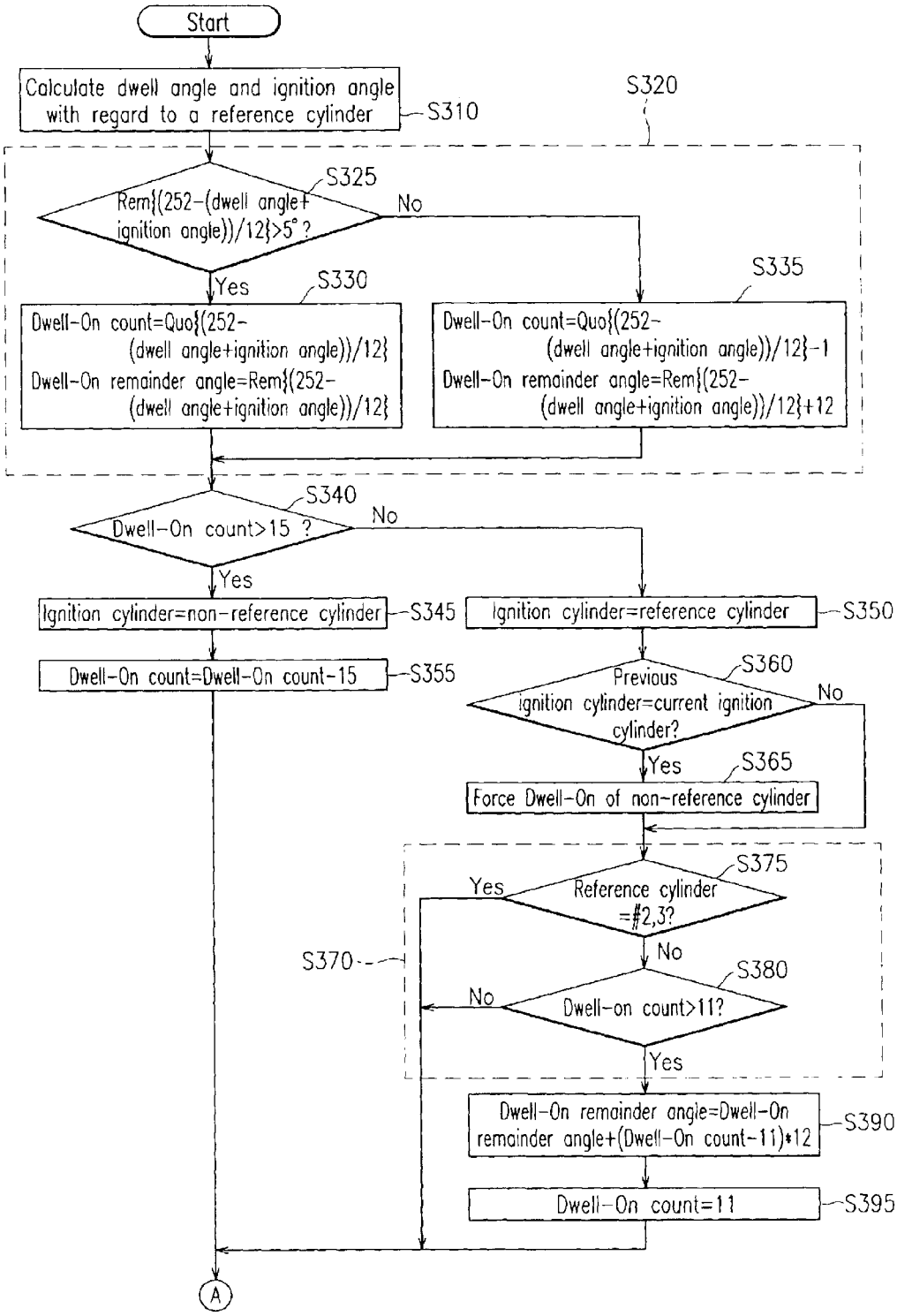
FIGS. 3A and 3B are flowcharts showing an ignition control method according to a preferred embodiment of the present invention.
Figure 3B:
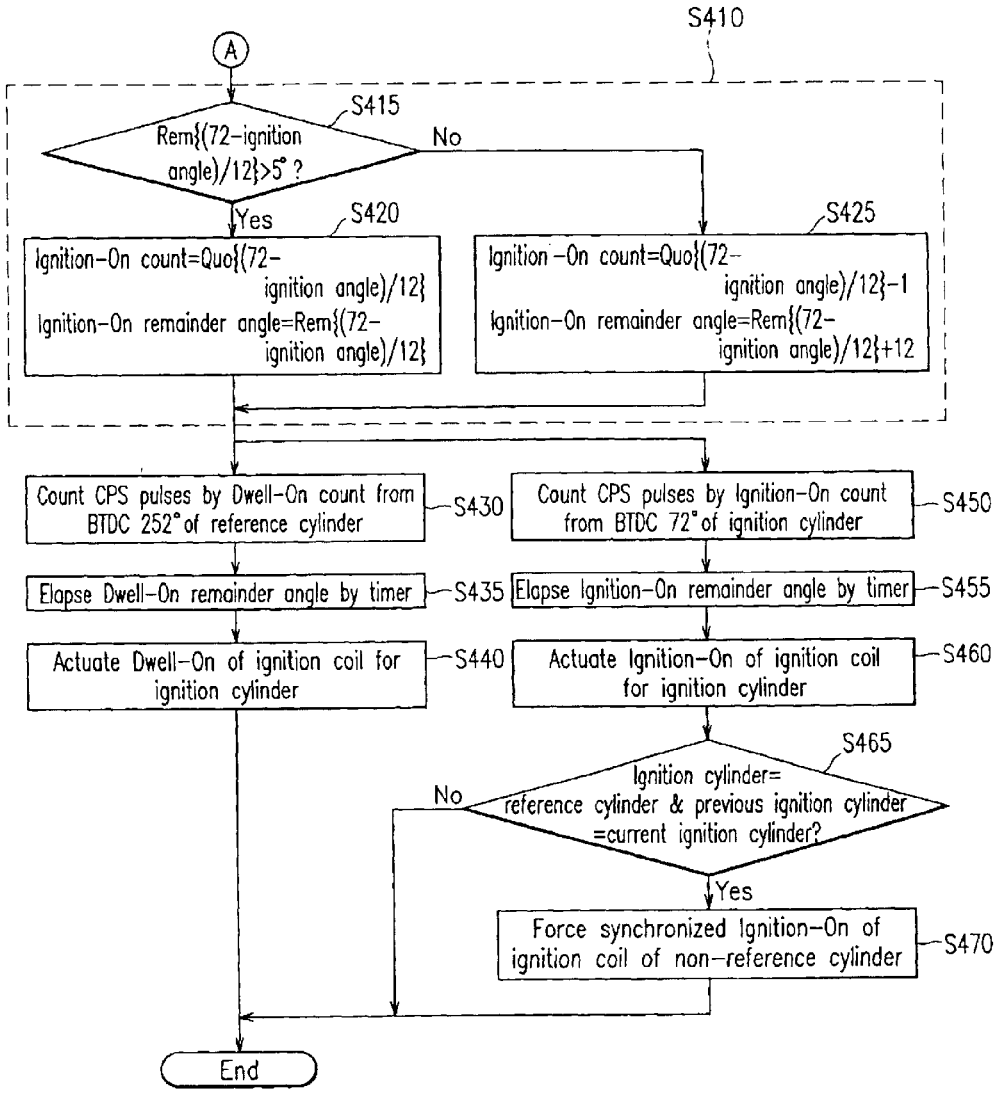

FIGS. 3A and 3B are flowcharts showing the ignition control method according to a preferred embodiment of the present invention.

Referring to FIGS. 3A and 3B, the ignition control method is recursively performed according to engine revolution. In this method, at step S310 the ECU 250 calculates the dwell angle and the ignition angle of a reference cylinder based on the engine speed. This corresponds to time point 1 in FIG. 1, for the reference cylinder #2 or #3. At step S320, the ECU 250 calculates a first number of pulses (referred to as "dwell-on count") and a first timer-monitored angle (referred to as "dwell-on remainder angle") corresponding to a pre-dwell-on period for the reference cylinder. The pre-dwell-on period is the period from a first reference pulse ("dwell-on reference pulse," time point 1 in FIG. 1) to the dwell-on point for the reference cylinder (time point 3 in FIG. 1).

The dwell-on reference pulses are, as shown in FIG. 1, the second pulse after the missing pulses of the crank-position sensor and a pulse having a 180° angular difference thereto. That is, the second pulse (at point 1 in FIG. 1) after the missing pulses is selected as the dwell-on reference pulse of cylinders #2 and #3, and the latter-described pulse (at time point 4 in FIG. 1) is selected as the dwell-on pulse of cylinders #1 and #4.

The step S320 of calculating the dwell-on count and the dwell-on remainder angle is described in further detail as follows. At step S325, the ECU 250 compares the remainder of a first operation with a reference angle (5°). The first operation includes dividing an angular difference, acquired by subtracting the sum of the dwell angle and the ignition angle from a BTDC angle of the first reference pulse (252°), by the angular difference (12°) between adjacent pulses. This first operation is represented by equation (1).

$$X = \text{Remainder}\left\{\frac{252 - (\text{dwell angle} + \text{ignition angle})}{12}\right\}. \qquad \text{Equation (1)}$$

The number "252" is changed when the positions of missing pulses (teeth) are altered. One of ordinary skill in the art will know to change the BTDC angle to account for systemic differences. The number "12" represents the resolution of the crank-position sensor 210. The reference angle is chosen to be less than the angular difference between adjacent pulses and greater than the angle corresponding to the time required for the timer to be activated. The value of "5" is obtained from experiments as such an angle for typical engine specifications and ECU 250 processor performance.

When the remainder of the first operation is greater than the reference angle, the ECU 250 determines the Dwell-On count as a quotient of the first operation and the Dwell-On remainder angle as the remainder of the first operation at step S330. When the remainder of the first operation is not greater than the reference angle, the ECU 250 determines the Dwell-On count as a quotient of the first operation minus 1, and the Dwell-On remainder angle as the remainder of the first operation plus the angular difference between adjacent pulses at step S335.

For example, when the dwell angle is 100° and the ignition angle is 27°, the remainder of the first operation is 5°, which is not greater than the reference angle. In this case, the dwell-on count becomes 9 (the quotient of $$\left\{\frac{252 - (100 + 27)}{12}\right\}$$

is 10) and the dwell-on remainder angle becomes 17°. As another example, when the dwell angle is 100° and the ignition angle is 26°, the remainder of the first operation is 6°, which is greater than the reference angle. In this case, the dwell-on count becomes 10 and the dwell-on remainder angle becomes 6°. In this way, the starting point of the timer-elapsed period can be set by setting the reference angle. Accordingly, the total period that has to be monitored by the timer can be minimized.

At step S340, the ECU 250 compares the dwell-on count with a reference number of pulses that correspond to 180° of crank angle, which is 15 when the resolution of the crank-position sensor 210 is 12°. At step S345, the ECU 250 concludes an ignition cylinder is not the reference cylinder since the dwell-on count was greater than the reference number of pulses. Otherwise, at step S350 the ECU concludes an ignition cylinder is the reference cylinder. If the ignition cylinder is not the reference cylinder, a cylinder whose ignition timing precedes that of the reference cylinder by 180° of crank angle is determined as the ignition cylinder at step S345.

A "non-reference cylinder" is hereinafter used as the meaning of a cylinder whose ignition timing precedes that of the reference cylinder by 180° of crank angle.

After the ignition cylinder is determined, the ECU 250 actuates the ignition coil of the ignition cylinder based on the dwell-on count, the dwell-on remainder angle, and the ignition angle calculated with reference to the reference cylinder, which is described in further detail below.

When the ignition cylinder is not the reference cylinder, at step S355 the ECU 250 reduces the dwell-on count by the reference number (15) because the dwell-on point of the ignition cylinder precedes the dwell-on point of the reference cylinder by 180°. In this way, when the dwell-on count is determined to be sufficiently large at step S340, that is, when a long period must elapse from the occurrence of the dwell-on reference pulse to the dwell-on point, a cylinder having earlier ignition timing can be fired. Thus, a currently calculated dwell angle and ignition angle can be more promptly applied to engine operation.

Now referring to FIG. 3B, after the dwell-on count is reduced at step S355, at step S430 after a calculation step S410 which will be explained later in detail, the ECU 250 counts pulses of the dwell-on count from occurrence of the dwell-on reference pulse (252° BTDC with respect to the reference cylinder). Subsequently, at step S435, the ECU 250 waits for the duration of the dwell-on remainder angle using the timer 255 after counting the dwell-on count number of pulses. At step S440, after finishing the dwell-on remainder angle, the ECU 250 actuates dwell-on of the ignition coil of the ignition cylinder.

If the ignition cylinder is the reference cylinder, the process of dwell-on actuation is more complex because it must prevent a misfire from occurring when the engine speed increases. The reason for this is thus. At a low engine speed, the dwell angle and the ignition angle are small. Therefore, the ignition cylinder becomes different from the reference cylinder because at step S340 the dwell-on count is large. On the other hand, at a high engine speed, the ignition cylinder is the same as the reference cylinder because the dwell angle and the ignition angle are large. Thus, when the engine speed increases, a misfire can take place, as explained with reference to FIG. 4.

Figure 4:
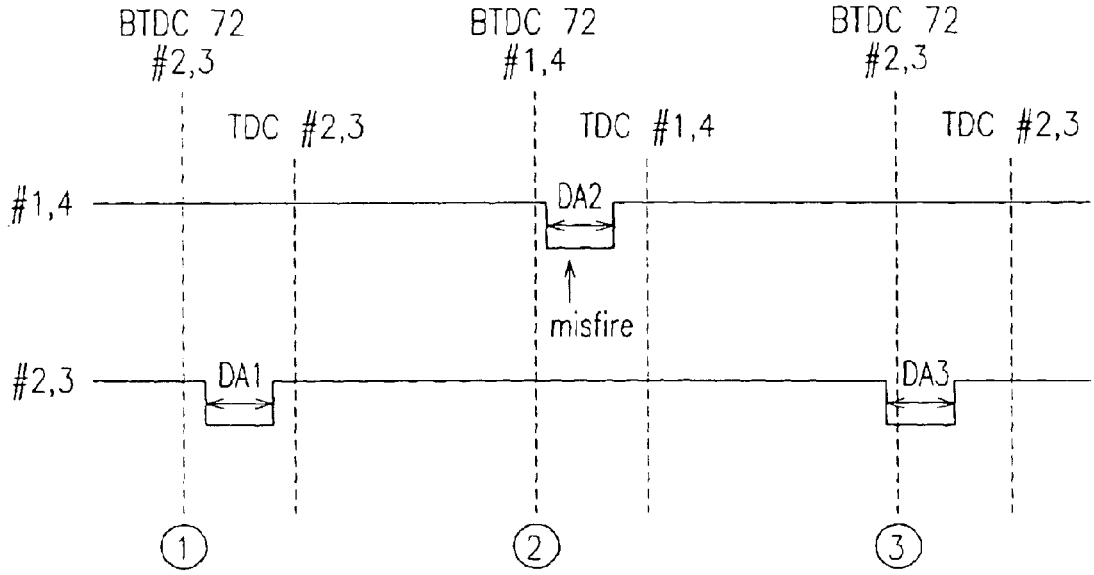
FIG. 4 is a simplified timing diagram for showing a situation where a misfire takes place while the engine speed increases.

Assume that the crankshaft is currently at the time of 2 in FIG. 4. During the previous ignition control process time (1) in FIG. 4, cylinders #2 and #3 were fired based on a dwell angle DA2 calculated in connection with reference cylinders #1 and #4. Now at the time of 2 when the engine speed has increased (the dwell-on count has decreased) such that the pre-dwell-on period (from (1) to (3) of FIG. 1) calculated based on a dwell angle DA3 is smaller than 180°, the cylinders #2 and #3 are again processed to be fired. Therefore, one of the cylinders #1 and #4 misfires once while the engine speed increases. Such a misfire does not occur while the engine speed decreases.

Therefore, to prevent a misfire, the ECU 250 determines at step S360 if the current ignition cylinder, which from steps S340 and S350 was determined to be the reference cylinder, was also the ignition cylinder previously. If so, at step S365, the ECU 250 forcibly actuates dwell-on of the ignition coil of the non-reference cylinder.

A problematic situation that must also be considered occurs when a target pulse, occurring after the dwell-on reference pulse and within the dwell-on count, corresponds to a missing pulse. In this situation the dwell-on count is incorrectly counted. To prevent such a situation, at step S370 the ECU 250 determines if a target pulse occurring after the dwell-on reference pulse by the dwell-on count lies in a missing pulse range. If the target pulse lies in the missing pulse range, at step S390 the ECU 250 increases the dwell-on remainder angle by the angle obtained by multiplying a reduced number of the dwell-on count by the angular difference between adjacent pulses. The reduced dwell-on count at step S390 ensures that the target pulse no longer lies in the missing pulse range. The missing pulse range is preferably set to include the missing pulses and the first pulse occurring after the missing pulses. And, at step S395, the ECU 250 resets the dwell-on count to the value of 11, which corresponds to a pulse just before the missing pulses in FIG. 1.

In more detail, in step S375, the ECU 250 determines if the reference cylinder is one of the cylinders #2 and #3. If not, the ECU at step S380 determines if the dwell-on count is greater than 11. Whether the reference cylinder is one of cylinders #2 and #3 is taken into account because the dwell-on point for cylinders #2 and #3 never lies within the missing pulse range, according to the timing diagram of FIG. 1. The value 11 is adopted in step S380 because the pulse just before the missing pulses corresponds to the 11th pulse from the dwell-on reference pulse (time (4) in FIG. 1) of the cylinders #1 and #4 according to FIG. 1.

The details for the step S370 and values adopted at steps S390 and S395 may vary with factors such as the angular position of missing pulses and the resolution of the crank-position sensor 210. But the appropriate modification of the values for these changes will be apparent to a person of ordinary skill in the art.

After the steps S360–S395 are employed to prevent misfiring, at step S430 the ECU 250 counts pulses for the dwell-on count. The step S430 is executed after step S410 which will be explained in detail later. In step S435 the ECU 250 delays for the dwell-on remainder angle using the timer 255. Then the ECU 250, in step S440, actuates dwell-on of the ignition coil for the ignition cylinder, the same as if the ignition cylinder had been the non-reference cylinder in step S340.

Steps for firing the spark plugs at the ignition-on point are as follows. At step S410, the ECU 250 calculates a second number of pulses (referred to as "ignition-on count") and a second timer-monitored angle (referred to as "ignition-on remainder angle"). These correspond to a pre-ignition-on period of the ignition cylinder. The pre-ignition-on period is a period from occurrence (time 4 in FIG. 1) of a second reference pulse (referred to as "ignition-on reference pulse" hereinafter) to an ignition-on point (time (6) in FIG. 1) with regard to the ignition cylinder. In step S415, the ECU 250 compares a remainder of a second operation with a reference angle (for example, 5°). The second operation is an operation of dividing an angular difference, acquired by subtracting the ignition angle from a BTDC angle (that is, 72°) of the ignition-on reference pulse, by an angular difference (that is, 12°) between adjacent pulses. This second operation is represented by equation (2).

$$Y = \text{Remainder}\left\{\frac{72 - \text{ignition angle}}{12}\right\}. \quad \text{Equation (2)}$$

The number "72" can be changed for various modifications of the present invention, by a person or ordinary skill in the art. As before, the reference angle is chosen to be less than the angular difference between adjacent pulses and greater than an angle corresponding to the time required for the timer 255 to be activated. The value of "5" was obtained from experiments as such an angle for typical engine specifications and processor performance.

If the remainder of the second operation is greater than the reference angle, at step S420 the ECU 250 calculates the ignition-on count as the quotient of the second operation, and the ignition-on remainder angle as the remainder of the second operation. If the remainder of the second operation is not greater than the reference angle, at step S425 the ECU 250 calculates the ignition-on count as a quotient of the second operation minus 1, and the second timer-monitored angle as the remainder of the second operation plus the angular difference between adjacent pulses. The calculation step S410 is executed before starting the dwell-on actuation process S430–S440.

The firing process S450–S460, based on the ignition-on count and the ignition-on remainder angle, is executed in parallel with the dwell-on actuation process S430–S440. At step S450 the ECU 250 counts the pulses of the ignition-on count from the occurrence (72° BTDC of the ignition cylinder) of the ignition-on reference pulse. At step S455, the ECU 250 monitors the ignition-on remainder angle using the timer 255. At step S460, the ECU 250 actuates ignition-on of the ignition coil of the ignition cylinder when the ignition-on remainder angle has passed.

In addition, the ECU 250 determines at step S465 if the ignition cylinder is the reference cylinder and if the previous ignition cylinder was also the reference cylinder. If so, at step S470, the ECU 250 forcibly actuates ignition-on of the ignition coil of the non-reference cylinder synchronously with the ignition-on actuation step S460 for the ignition cylinder.

According to a preferred embodiment of the present invention, ignition timing is precisely controlled to cope with a rapidly varying dwell angle because a cylinder having an earlier ignition timing can be fired if a sufficiently long period must elapse from the occurrence of the dwell-on reference pulse to the dwell-on point . Furthermore, the timer-monitored period can be minimized by setting a parameter so that the precision of dwell-on point and ignition-on point is further enhanced. In addition, misfires that could possibly occur during transition of firing cylinders are prevented by forced dwell-on and ignition-on. Moreover, the erratic detection of the end of the tooth-counted period, possibly caused by missing pulses, is prevented.

While this invention has been described in connection with what are presently considered to be the most practical and preferred embodiments, it is to be understood that the invention is not limited to the disclosed embodiments, but, on the contrary, is intended to cover various modifications and equivalent arrangements included within the spirit and scope of the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. An ignition control method for an engine, comprising:

calculating a dwell angle and an ignition angle of a reference cylinder based on an engine speed;

calculating a first number of pulses and a first timer-monitored angle corresponding to a pre-Dwell-On period with regard to the reference cylinder, the pre-Dwell-On period being a period from occurrence of a first reference pulse to a Dwell-On timing with regard to the reference cylinder;

comparing the first number of pulses with a reference number of pulses that correspond to 180° of crank angle;

determining an ignition cylinder based on the comparison of the first number with the reference number; and actuating ignition of a spark plug of the ignition cylinder based on the first number of pulses, the first timer-monitored angle, and the ignition angle of the reference cylinder.

2. The method of claim 1, wherein the first reference pulse is either a second pulse after a missing pulse of a crank-position sensor or a pulse having a 180° angular difference from the second pulse.

3. The method of claim 1, wherein said calculating a first number of pulses and a first timer-monitored angle comprises:

comparing a remainder of a first operation with a reference angle, the first operation being an operation of dividing an angular difference, the angular difference being a BTDC angle of the first reference pulse minus the sum of the dwell angle and the ignition angle, by an angular difference between adjacent pulses;

determining, when the remainder of the first operation is greater than the reference angle, the first number of pulses as a quotient of the first operation and the first timer-monitored angle as the remainder of the first operation; and determining, when the remainder of the first operation is not greater than the reference angle, the first number of pulses as a quotient of the first operation minus 1 and the first timer-monitored angle as the remainder of the first operation plus the angular difference between adjacent pulses.

4. The method of claim 3, wherein the reference angle is less than the angular difference between adjacent pulses and greater than an angle corresponding to a required time for a timer to be activated.

5. The method of claim 3, wherein the reference angle is about 5°.

6. The method of claim 1, wherein said determining an ignition cylinder based on the comparison determines the ignition cylinder as the reference cylinder when the first number is not greater than the reference number, and as a non-reference cylinder otherwise.

7. The method of claim 6, wherein said actuating ignition of a spark plug of the ignition cylinder comprises:

reducing the first number of pulses by the reference number when the ignition cylinder is different from the reference cylinder;

counting the first number of pulses from the first reference pulse;

monitoring with a timer for the first timer-monitored angle after said counting the first number of pulses; and actuating dwell-on of an ignition coil of the ignition cylinder after the first timer-monitored angle has passed.

8. The method of claim 7, wherein said actuating ignition of a spark plug of the ignition cylinder further comprises:

determining if the reference cylinder is the ignition cylinder, and if a previous ignition cylinder was the reference cylinder; and forcibly actuating dwell-on of an ignition coil of said non-reference cylinder if the previous ignition cylinder and the ignition cylinder are the reference cylinder.

9. The method of claim 7, further comprising:

determining if a target pulse occurring after the first number of pulses after the first reference pulse lies in a missing pulse range, said missing pulse range covering a missing pulse;

reducing the first number of pulses when the target pulse lies in the missing pulse range, so that the target pulse no longer lies in the missing pulse range; and increasing the first timer-monitored angle by an angle obtained by multiplying a reduced number of the first number of pulses by the angular difference between adjacent pulses.

10. The method of claim 9, wherein the missing pulse range includes the missing pulse and the first pulse after the missing pulse.

11. The method of claim 7, wherein said actuating ignition of a spark plug of the ignition cylinder further comprises:

calculating a second number of pulses and a second timer-monitored angle corresponding to a pre-ignition-on period for the ignition cylinder, the pre-ignition-on period being a period from a second reference pulse to an Ignition-on point for the ignition cylinder;

counting the second number of pulses from the second reference pulse;

monitoring by the timer for the second timer-monitored angle after said counting the second number of pulses; and actuating ignition-on of the ignition coil of the ignition cylinder after the second timer-monitored angle has passed.

12. The method of claim 11, wherein said calculating a second number of pulses and a second timer-monitored angle comprises:

comparing a remainder of a second operation with the reference angle, the second operation being an operation of dividing a second angular difference, acquired by subtracting the ignition angle from a BTDC angle of the second reference pulse, by the angular difference between adjacent pulses;

determining, when the remainder of the second operation is greater than the reference angle, the second number of pulses as a quotient of the second operation and the second timer-monitored angle as the remainder of the second operation; and determining, when the remainder of the second operation is not greater than the reference angle, the second number of pulses as a quotient of the second operation minus 1 and the second timer-monitored angle as the remainder of the second operation plus the angular difference between adjacent pulses.

13. The method of claim 12, wherein the reference angle is less than the angular difference between adjacent pulses and greater than an angle corresponding to a required time for a timer to be activated.

14. The method of claim 12, wherein the reference angle is about 5°.

15. The method of claim 12, wherein said actuating ignition of a spark plug of the ignition cylinder further comprises:

determining if the reference cylinder is the ignition cylinder, and if a previous ignition cylinder was the reference cylinder; and forcibly actuating, ignition-on of an ignition coil of said non-reference cylinder if the previous ignition cylinder and the ignition cylinder are the reference cylinder.

16. An ignition control apparatus of an engine having a spark plug for each cylinder, the apparatus comprising:

a crank-position sensor for generating a pulse signal on rotation of a crankshaft except for one or more missing pulses;

an engine speed detector for detecting engine speed;

an ignition coil driven by an electric current for dwell-on and ignition-on activation, said ignition coil generating a voltage for ignition upon said ignition-on activation;

an electronic control unit for controlling said dwell-on and Ignition On activation of the ignition coil based on the pulse signal and the engine speed, wherein the electric control unit executes a set of instructions comprising instructions for:

calculating a dwell angle and an ignition angle of a reference cylinder based on an engine speed;

calculating a first number of pulses and a first timer-monitored angle corresponding to a pre-dwell-on period for the reference cylinder, the pre-dwell-on period being a period from a first reference pulse to a dwell-on point for the reference cylinder, and the pulses coming from a crank position sensor;

comparing the first number of pulses with a reference number of pulses that correspond to 180° of crank angle;

determining an ignition cylinder based on the comparison of the first number with the reference number; and actuating ignition of a spark plug of the ignition cylinder based on the first number of pulses, the first timer-monitored angle, and the ignition angle of the reference cylinder.

17. The apparatus of claim 16, wherein said calculating a first number of pulses and a first timer-monitored angle comprises:

comparing a remainder of a first operation with a reference angle, the first operation being an operation of dividing an angular difference, the angular difference being a BTDC angle of the first reference pulse minus the sum of the dwell angle and the ignition angle, by an angular difference between adjacent pulses;

determining, when the remainder of the first operation is greater than the reference angle, the first number of pulses as a quotient of the first operation and the first timer-monitored angle as the remainder of the first operation; and determining, when the remainder of the first operation is not greater than the reference angle, the first number of pulses as a quotient of the first operation minus 1 and the first timer-monitored angle as the remainder of the first operation plus the angular difference between adjacent pulses.

18. The apparatus of claim 17, wherein the reference angle is less than the angular difference between adjacent pulses and greater than an angle corresponding to a required time for a timer to be activated.

19. The apparatus of claim 16, wherein said determining an ignition cylinder based on the comparison determines the ignition cylinder as the reference cylinder when the first number is not greater than the number, and as a non-reference cylinder otherwise.

20. The apparatus of claim 19, wherein said actuating ignition of a spark plug of the ignition cylinder comprises:

reducing the first number of pulses by the number when the ignition cylinder is different from the reference cylinder;

counting the first number of pulses from the first reference pulse;

monitoring with a timer for the first timer-monitored angle after said counting the first number of pulses; and actuating dwell-on of an ignition coil of the ignition cylinder after the first timer-monitored angle has passed.

21. The apparatus of claim 20, wherein said actuating ignition of a spark plug of the ignition cylinder further comprises:

determining if the reference cylinder is the ignition cylinder, and if a previous ignition cylinder was the reference cylinder; and forcibly actuating dwell-on of an ignition coil of said non-reference cylinder if the previous ignition cylinder and the ignition cylinder are the reference cylinder.

22. The apparatus of claim 20, wherein said set of instructions further comprises instructions for:

determining if a target pulse occurring after the first number of pulses after the first reference pulse lies in a missing pulse range, said missing pulse range covering a missing pulse;

reducing the first number of pulses when the target pulse lies in the missing pulse range, so that the target pulse no longer lies in the missing pulse range; and increasing the first timer-monitored angle by an angle obtained by multiplying the reduced first number of pulses by the angular difference between adjacent pulses.

23. The apparatus of claim 20, wherein said actuating ignition of a spark plug of the ignition cylinder further comprises:

calculating a second number of pulses and a second timer-monitored angle corresponding to a pre-ignition-on period for the ignition cylinder, the pre-ignition-on period being a period from a second reference pulse to an Ignition-on point with regard to the ignition cylinder;

counting the second number of pulses from the second reference pulse;

monitoring by the timer for the second timer-monitored angle after said counting the second number of pulses; and actuating ignition-on of the ignition coil of the ignition cylinder after the second timer-monitored angle has passed.

24. The apparatus of claim 23, wherein said calculating a second number of pulses and a second timer-monitored angle comprises:

comparing a remainder of a second operation with the reference angle, the second operation being an operation of dividing a second angular difference, acquired by subtracting the ignition angle from a BTDC angle of the second reference pulse, by the angular difference between adjacent pulses;

determining, when the remainder of the second operation is greater than the reference angle, the second number of pulses as a quotient of the second operation and the second timer-monitored angle as the remainder of the second operation; and determining, when the remainder of the second operation is not greater than the reference angle, the second number of pulses as a quotient of the second operation minus 1 and the second timer-monitored angle as the remainder of the second operation plus the angular difference between adjacent pulses.

25. An ignition control method for an engine, comprising:

calculating a dwell angle and an ignition angle for a reference cylinder;

calculating a first number of pulses and a first timer-monitored angle for the reference cylinder;

comparing the first number of pulses with a reference number of pulses that correspond to 180° of crank angle;

determining an ignition cylinder based on the comparison of the first number of pulses with the reference number; and actuating ignition of the ignition cylinder based on the first number of pulses, the first timer-monitored angle, and the ignition angle.

* * * * *